United States Patent [19]

Coone

[11] 3,958,642

[45] May 25, 1976

[54] QUICK LATCHING DRILL PIPE BLOWOUT PREVENTER AND METHOD OF USE THEREOF

[75] Inventor: Malcolm G. Coone, Houston, Tex.

[73] Assignee: Lynes, Inc., Houston, Tex.

[22] Filed: Sept. 2, 1975

[21] Appl. No.: 609,606

[52] U.S. Cl. ..... 166/315; 166/75 R; 166/86

[51] Int. Cl.[2] ..... E21B 19/00; E21B 43/00

[58] Field of Search ..... 166/315, 75, 77.5, 82, 166/85, 86, 96, 98; 175/207, 218, 57, 65; 251/1 R

[56] References Cited

UNITED STATES PATENTS

| | | | |
|---|---|---|---|
| 2,410,589 | 11/1946 | Segelhorst | 166/75 X |
| 2,897,895 | 8/1959 | Ortloff | 166/75 X |
| 3,282,336 | 11/1966 | Wakefield, Jr. | 166/315 X |
| 3,323,773 | 6/1967 | Walker | 166/82 X |

*Primary Examiner*—Stephen J. Novosad
*Attorney, Agent, or Firm*—William C. Norvell, Jr.

[57] ABSTRACT

A blowout preventer for the drill string of a subterranean well which is quickly and sealingly latchable to the upper tool joint of the string in the event of a well blowout. The blowout preventer basically comprises first and second tubular housing members, means defining a valve within one of said tubular housing members, means carried by one of said housing members for grasping a well tool joint, seal elements carried by said housing member for cooperation with said means defining a valve for containment of fluid within said apparatus, and means for selectively removing one of said housing members from the other of said housing members. A method of containing well and drilling fluids using the blowout preventer also is disclosed.

20 Claims, 6 Drawing Figures

QUICK LATCHING DRILL PIPE BLOWOUT PREVENTER AND METHOD OF USE THEREOF

BACKGROUND OF THE INVENTION

1. FIELD OF THE INVENTION:

The invention pertains to a quick latching drill pipe blowout preventer for use on a rig for a subterranean well during drilling operations.

2. DESCRIPTION OF THE PRIOR ART:

During the drilling of a subterranean well, produced hydrocarbons may start flowing through the drill pipe while a connection is being made at the well surface or during tripping, either into or out of the hole. When this occurs, the possibility of a well blowout must be prevented by closing the drill pipe string. In most instances, the fluid flowing to the top of the well through the drill string will be at a very high velocity, thus not allowing sufficient time to stab the kelly joint into the upper tool joint of the drill string to completely shut off the flow of fluid before the ejection of the fluid above the rig floor. All wells being drilled are equipped with blowout preventers to control flow of fluids coming up the drill pipe-casing annulus. However, the blowout preventers do not affect the interior of the drill pipe.

It is therefore an object of the present invention to provide a manually operable blowout preventer which may be sealingly latched onto the upper end of a drill pipe tool joint.

It is a further object of the present invention to provide a sealingly latchable drill pipe blowout preventer which is carriable by the kelly.

It is also an object of the present invention to provide a sealingly latchable blowout preventer carriable by the kelly, the outer housing of said blowout preventer being easily and quickly removable from the inner or main body thereof.

It is a further object of the present invention to provide a sealingly latchable blowout preventer carried by a kelly, the main body of said blowout preventer being separable from the outer housing thereof such that said body becomes an integral part of the tubing string for running into the well to a desired depth in order to circulate fluid to kill the well.

It is a further object of the present invention to provide a latchable blowout preventer carried by the kelly which will sealingly engage a tool joint when stabbed thereon without requiring tubular rotation for sealing engagement.

Other objects and advantages of the present invention will be apparent from a reading of the FIGS., the specification and the claims.

SUMMARY OF THE INVENTION

The present invention incorporates a drill string blowout preventer for a subterranean well, the blowout preventer depending from a kelly joint, and comprises first and second tubular housing members, one of said housing members being initially and selectively dependent from said kelly joint, the other of said housing members being engageable onto the drill string with the housing members being selectively removable from each other. The blowout preventer also has means defining a valve within one of said tubular housing members, means carried by one of said housing members for grasping said drill string, seal elements carried by said housing members for cooperation with said means defining a valve for entrainment of fluid within said blowout preventer, and means for selectively removing one of said housing members from the other of said housing members.

DESCRIPTION OF THE PREFERRED EMBODIMENTS

Figure 1:
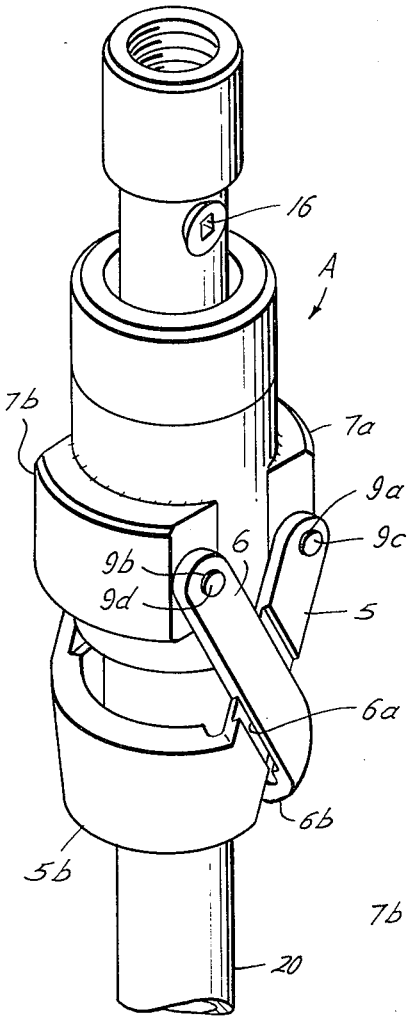
FIG. 1 is a general but complete outer view of the blowout preventer of the present invention in sealing engagement with a tool joint forming the upper end of the drill string.
Figure 2:
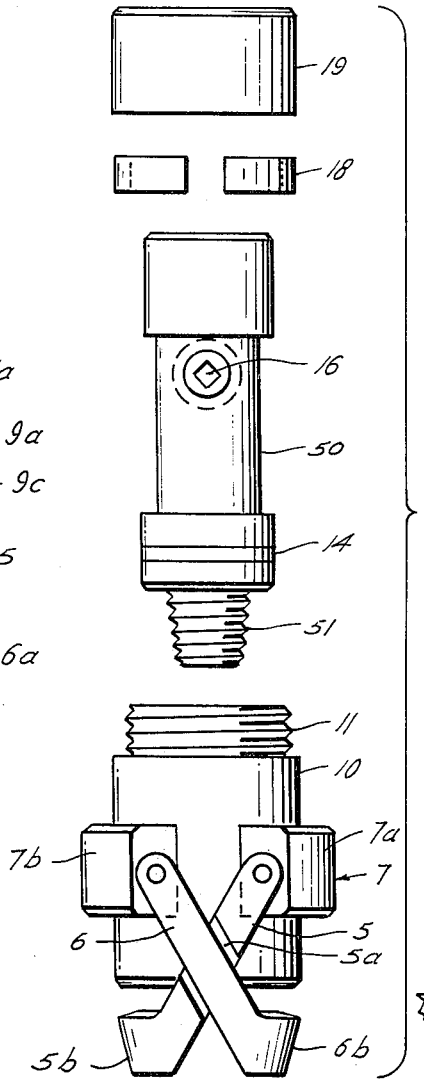
FIG. 2 is a side elevational drawing depicting the various separated elements of the blowout preventer.

Referring to the FIGS., the apparatus A basically is comprised of an outer housing 40 which is selectively removable from an inner body 50. The outer housing 40 is composed of a split retainer ring 18 engaged within its companion grooveway 18a, the ring 18 being housed within a retainer cap member 19 connected such as by threads 11 to a central housing member 10 therebelow. Within a circumferentially extending longitudinal grooveway **23*a* in the central housing 10 is an elastomeric or rubber seal element 23 for sealing engagement on the exterior of a tool joint 20** (which can be a drill collar or the like) in the operation as described below.

Figure 3:
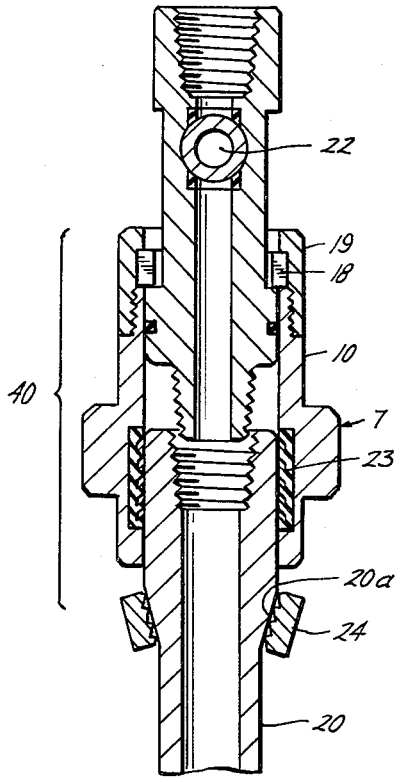
FIG. 3 is a longitudinal sectional drawing of the blowout preventer of the present invention sealingly stabbed over a tool joint with the valve element in closed position.
Figure 4:
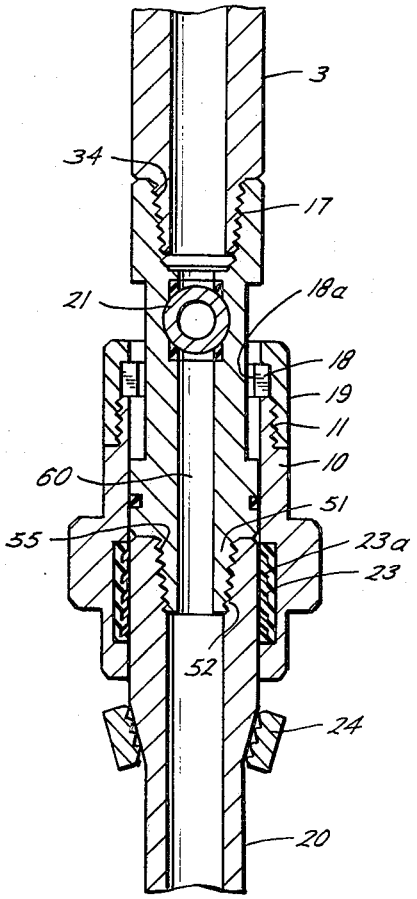
FIG. 4 is a view similar to that shown in FIG. 3 and shows the blowout preventer of the present invention in sealing engagement with a tool joint and the blowout preventer lower thread connected to the thread of the tool joint by rotation of the kelly.

Protruding outwardly from and forming a part of the central housing 10 is a tong ring 7 having circular sectional elements **7*a* and 7*b* which are substantially equal in circumference. The tong ring elements 7*a* and 7*b* provide grooves or holes 9*a* and 9*b*, respectively, for receipt of lock pins 9*c* and 9*d* which engage to the tong ring 7 slidable criss-crossed tong arms 5 and 6. The arms 5 and 6 are crossed within companion slide grooves 5*a* and 6*a* respectively on each side of the central housing 10, so that each tong may pivot about its respective pin 9*c* and 9*d* with respect to the other, thus permitting slight travel of the arms 5 and 6 to achieve grasping of the tool joint 20 by means of protruding grasping elements 24 interiorally formed on each of encircling tong elements 5*b* and 6*b* depending from the arms 5 and 6 of the tong ring 7. As shown in FIGS. 3 and 4, the tool joint tong arms 5 and 6 provide interiorally spaced and protruding grasping elements 24 for selective engagement upon the outer face of the tool joint 20, the outer face having an angularly protruding shoulder 20*a* providing resistance to upward movement of the apparatus A when the kelly joint 3 is raised or when pressure from within the drill pipe is exerted against the valve element 21**.

The inner or main body 50 of the apparatus A is slidably and sealably contained within but selectively removable from the outer housing 40 and basically consists of an exterior valve control 16 for manual manipulation of a valve element 21 housed within the body 50 for control of fluid flow within a central longitudinal passage 60 which is communicable with companion passageways within the kelly joint 3 thereabove and the tool joint 20 therebelow. The body 50 also has circumferentially extending seal elements 14 housed within companion grooves 14*a* on the exterior of the body 50 for prevention of fluid communication between the body 50 and the outer housing 40. Thread elements 17 are provided on the uppermost portion of the body 50 for engagement with companion thread elements 34 on the kelly 3, while threads 55 are provided on the lowermost end 51 of the body 50 for engagement with companion threads 52 on the upper portion of the tool joint 20.

The valve element 21 is shown in the FIGS. as a ball type valve which may be reciprocated into the open and closed position by manipulation of the outer valve control 16, with valve port 22 providing fluid communication between the flow passage 60 and the interior of the kelly joint 3 when the valve element 21 is in open position and preventing such communication when the vlave element 21 is in closed position.

Figure 6:
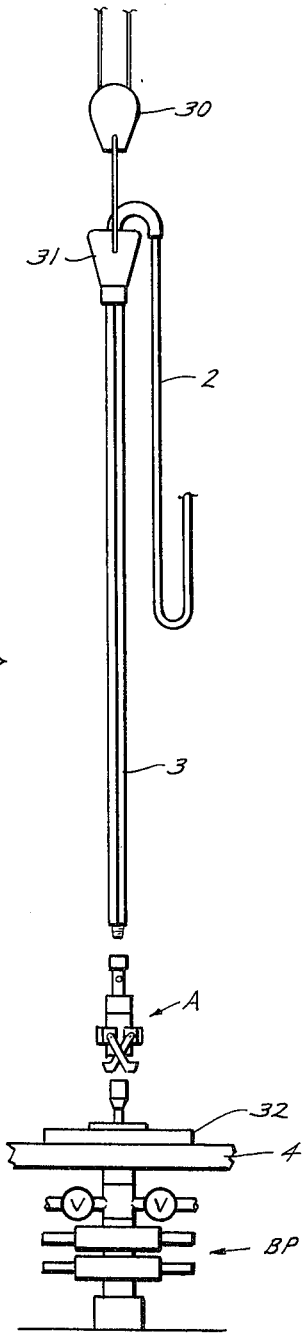
FIG. 6 is a longitudinal diagramatic view showing the blowout preventer apparatus in relation to cooperating components of a drilling rig.

In the operation of the blowout preventer apparatus of the present invention, the apparatus A is affixed to the lower end of the kelly joint 3 (FIG. 6) which, in turn, is carried by a swivel 31 extending from a traveling block 30. A flow path within the kelly joint 3 communicates with an extending flow path provided by mud hose 2 to the mud pit (not shown), the upper end of the hose 2 being engaged within the swivel 31. The blowout preventer apparatus A is engageable on a tool joint 20 extending through the rotary table 32 on the rig floor 4 and passes through a blowout preventer stack BP therebelow.

Upon detection of a blowout, the apparatus A, with the valve element 21 reciprocated to "open" position, is lowered over the tool joint 20 by longitudinal movement of the kelly joint 3. When the tool joint tong elements 5*b* and 6*b* contact the upper end of the tool joint 20, the weight of the outer housing 40 will cause the tong arms 5 and 6 each to expand slightly outwardly to permit the tong elements 5*b* and 6*b* to pass over the top of the joint 20. During this operation, with valve element 21 in open position, the well fluids will "blow out" through the kelly joint 3 and subsequently to the mud pit thereby relieving the pressure in the drill string in the well. After the tong elements 5*b* and 6*b* pass just slightly below an outwardly protruding and encircling shoulder 20*a* on the tool joint 20, the kelly joint 3 is raised to permit the tong elements 5*b* and 6*b* to contract laterally and to permit the protruding grasping elements 24 to engage the shoulder 20*a* and thereby hold the apparatus A on the tool joint 20. In the event that there already is sufficient length of drill pipe in the well, mud can be pumped through the apparatus A and the drill string to kill the well. However, in the event that it is desirable to run additional length of drill pipe into the well, the valve element 21 can be left in open position and the kelly weight set down on the apparatus A. The valve 21 is reciprocated to closed position only after the kelly joint 3 and the apparatus A have been made into the drill string.

As shown in FIG. 3, flow of fluid through the blowout preventer apparatus A is prevented by valve port 22 of valve element 21 being in closed position, while the seal elements 23 or similar element 14 prevent flow of fluid between the inner main body 50 and the outer housing 40.

After locking the blowout preventer in place as described above and shown in FIG. 3, the kelly joint 3 and the blowout preventer apparatus A connected to the lower end thereof are rotated to permit the main body 50 of the apparatus A to be sealingly engaged with and made into the tool joint 20, as shown in FIG. 4. As the kelly joint 3 and the body 50 are rotated for threaded engagement of the body 50 into the tool joint 20, weight is applied to the kelly joint 3 resulting in the kelly 3 and the body 50 being completely integrated with the tool joint 20. The kelly joint 3 may then be rotated to unthread its lower end from the body 50.

After removal of the kelly joint 3 from the apparatus A, the outer housing 40 is removed therefrom so that the inner body 50 may be retained on the tool joint 20 and become an integral part of the drill string. With the valve element 21 still in closed position, the retainer cap member 19 is rotated by wrench or other tool and removed from the central housing 10 carrying the sectional elements 7*a* and 7*b*. Thereafter, the tool joint tong arms 5 and 6 can be removed from the body 50 over the top thereof by removing each of the elements of the split retainer ring 18, leaving only the body 50 in place over the tool joint 20.

Figure 5:
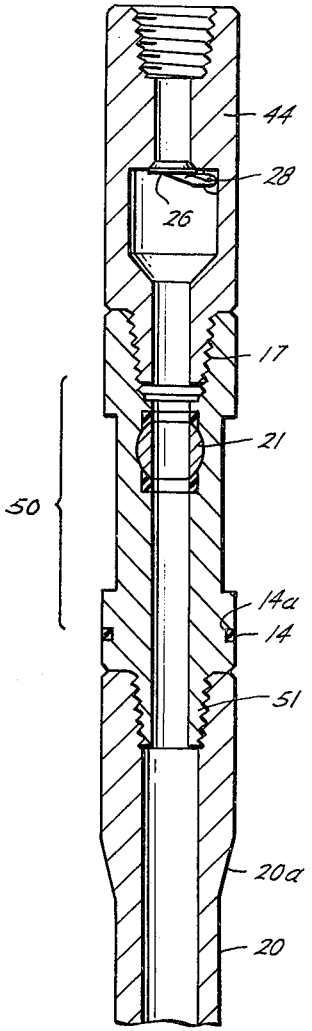
FIG. 5 is a view similar to those shown in FIGS. 3 and 4 and shows the main body of the blowout preventer separated from the outer housing thereof, the valve element being in open position and a back pressure sub being engaged to the top of the blowout preventer main body.

After removal of the outer housing 40 from the body 50 of the apparatus A, a back pressure sub 44, which may or may not be affixed to the lower end of the kelly joint 3, is stabbed into and threadedly connected to the upper part of the body 50. The back pressure sub 44 may be of any conventional type and is not a part of the apparatus A, but is utilized in controlling the well. The back pressure sub 44 permits downward flow of fluid therethrough but prevents upward flow of fluid therethrough by means of flapper valve head 26 affixed to the sub 44 by means of a pin 28. The tool then is as shown in FIG. 5. With the back pressure sub 44 affixed as described, and the main body 50 of the apparatus A being affixed to the lower end thereof, the tool joint 20 being affixed to the lower end of the body 50, the valve element 21 may be rotated by means of the valve control 16 on the outer portion of the body 50 to allow the valve port 22 to be in open position with respect to passageway 60. The flapper valve head 26 will prevent flow of fluid above the valve head 26 and will contain the fluid within the passageway 60. The tool, may be run on the drill string to a desired depth in the well and fluid circulated downwardly through the passageway 60 to kill the well, if desired.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be secured by Letters Patent is:

1. A blowout preventer for the drill string of a subterranean well comprising:

a. First and second tubular housing members;

b. Means defining a valve within one of said tubular housing members;

c. Means carried by one of said housing members for grasping a well tool joint on said drill string;

d. Seal elements carried by one of said housing members for cooperation with said means defining a valve to selectively contain fluid within said apparatus and to prevent fluid flow between the exterior of said well tool joint and the interior of the housing member carrying said seal elements; and e. Means for selectively removing one of said housing members from the other of said housing members.

2. The apparatus of claim 1 wherein one of the tubular housing members is at least partially housed within the other of said tubular housing members.

3. The apparatus of claim 1 wherein the first of the tubular housing members is at least partially housed within the second of said tubular housing members and the means defining a valve is within the first of the said tubular housing members.

4. The apparatus of claim 1 wherein the means carried by one of said housing members for grasping a well tool joint comprises a tong ring and coengaged companion tong elements depending from said ring and movable laterally of said housing members.

5. The apparatus of claim 1 wherein the means carried by one of said housing members for grasping a well tool joint comprises tongs depending from said housing member and movable laterally of said housing member.

6. The apparatus of claim 1 wherein the first and second housing members are sealingly engaged and are movable longitudinally with respect to each other.

7. The apparatus of claim 1 wherein the first and second housing members are sealingly engaged and are rotatable with respect to each other.

8. The apparatus of claim 1 wherein the first and second housing members are sealingly engaged and are movable rotatably and longitudinally with respect to each other.

9. The apparatus of claim 1 wherein the means for selectively removing one of said said housing members from the other of said housing members comprises the combination of (1) a split retainer ring element carried around one of said housing members, and (2) a retainer cap housing said ring and carried by the other of said housing members.

10. The apparatus of claim 1 additionally comprising means on the first of said housing members for engaging said well tool joint when the other of said tubular housing members is removed from the first of said housing members.

11. The apparatus of claim 1 additionally comprising means for engaging said first housing member with said tool joint before removing the said second tubular housing member from the first of said housing members.

12. A drill string blowout preventer for a subterranean well, said blowout preventer being engageable to a kelly joint, said blowout preventer comprising:

a. First and second tubular housing members, one of said housing members being initially and selectively dependable from said kelly joint, the other of said housing members being engageable on to the drill string, the housing members being selectively removable from each other;

b. Means defining a valve within one of said tubular housing members;

c. Means carried by one of said housing members for grasping said drill string;

d. Seal elements carried by said housing members for cooperation with said means defining a valve for entrapment of fluid within said blowout preventer; and e. Means for selectively removing one of said housing members from the other of said housing members.

13. The blowout preventer of claim 12 wherein one of said tubular housing members is at least partially housed within the other of said tubular housing members.

14. The blowout preventer of claim 12 wherein the first of the tubular housing members is at least partially housed within the second of said housing members and the means defining a valve is within the first of said tubular housing members.

15. The blowout preventer of claim 12 additionally comprising means on the first of said housing members for engaging said drill string when the other of said tubular housing members is removed from the first of said housing members.

16. The blowout preventer of claim 12 additionally comprising means on the first of said housing members for engaging said drill string before the other of said tubular housing members is removed from the first of said housing members.

17. A drill string control valve system for a subterranean well, said well having a kelly, comprising:

a. Upper and lower housing members, the upper of said housing members being carriable by the kelly, the lower of said housing members being integrally connectable to the drill string, the upper housing member being selectively disengageable from the lower of said housing members;

b. A third housing member for initially telescopically housing the lower of said housing members;

c. First valve means within one of said upper and lower housing members permitting downward flow of fluid and preventing upward flow of fluid therethrough;

d. Second valve means within the other of said housing members selectively controlling flow of fluid therethrough;

e. Means carried by said third housing member for grasping a well tool joint;

f. Seal elements carried by said third housing for cooperation with said second valve means for containment of fluid within said third housing member; and g. Means on said third housing member for selectively removing the third housing member from said lower housing member.

18. A method of containing well and drilling fluids within the drill pipe of a subterranean well during a blowout of said well through said drill pipe comprising the steps of:

a. Affixing to the lower end of a kelly joint a blowout preventer comprising: (1) first and second tubular housing members; (2) means defining a first valve within one of said tubular housing members; (3) means carried by one of said housing members for grasping a well tool joint; (4) seal elements carried by said housing members for cooperation with said means defining a valve for containment of fluid within said apparatus; (5) means for selectively removing one of said housing members from the other of said housing members; and (6) means on the first of said housing members for engaging said well tool joint before the other of said housing members is removed from the first of said housing members;

b. Sealingly engaging said blowout preventer onto the upper end of said drill pipe to direct flow of said fluids from said drill pipe into said kelly joint;

c. Activating said means on one of said housing members for engaging said tool joint;

d. Closing said valve to prevent said fluid from passing through said drill pipe to said kelly joint;

e. Removing the housing member carrying the means for grasping the well tool joint;

f. Connecting to the lower end of said kelly joint a sub having a second valve element preventing upward flow of fluid through the sub and permitting downward flow of fluid through the sub; and g. Engaging said sub to the upper end of said tubular housing member having therewithin said means defining a first valve.

19. A method of containing well and drilling fluids within the drill pipe of a subterranean well during a blowout of said well through said drill pipe comprising the steps of:

a. Affixing to the lower end of a kelly joint on said well a blowout preventer comprising: (1) first and second tubular housing members; (2) means defining a valve within one of said tubular housing members; (3) means carried by one of said housing members for grasping a well tool joint; (4) seal elements carried by said housing members for cooperation with said means defining a valve for containment of fluid within said apparatus: (5) means for selectively removing one of said housing members from the other of said housing members; and (6) means on the first of said housing members for engaging said well tool joint before the other of said housing members is removed from the first of said housing members;

b. Sealingly engaging said blowout preventer onto the upper end of said drill pipe to direct flow of said fluids from said drill pipe into said kelly joint;

c. Activating said means on one of said housing members for engaging said tool joint;

d. Removing the housing member carrying the means for grasping the well tool joint; and e. Closing said valve to prevent fluids from passing through said drill pipe to said kelly joint.

20. A method of containing well and drilling fluids within the drill pipe of a subterranean well during a blowout of said well through said drill pipe comprising the steps of:

a. Affixing to the lower end of a kelly joint on said well a blowout preventer comprising: (1) first and second tubular housing members; (2) means defining a valve within one of said tubular housing members; (3) means carried by one of said housing members for grasping a well tool joint; (4) seal elements carried by said housing member for cooperation with said means defining a valve for containment of fluid within said apparatus; (5) means for selectively removing one of said housing members from the other of said housing members; and (6) means on the first of said housing members for engaging said well tool joint before the other of said housing members is removed from the first of said housing members;

b. Sealingly engaging said blowout preventer onto the upper end of said drill pipe to direct flow of said fluids from said drill pipe into said kelly joint;

c. Activating said means on one of said housing members for engaging said tool joint;

d. Closing said valve to prevent fluids from passing through said drill pipe to said kelly joint; and e. Removing the housing member carrying the means for grasping the well tool joint.

* * * * *